US005484238A

United States Patent [19]

Bielagus

[11] Patent Number: 5,484,238

[45] Date of Patent: Jan. 16, 1996

[54] REFUSE BAG OPENING DEVICE

[75] Inventor: Joseph B. Bielagus, Tualatin, Oreg.

[73] Assignee: Beloit Technologies, Inc., Wilmington, Del.

[21] Appl. No.: 321,371

[22] Filed: Oct. 11, 1994

[51] Int. Cl.[6] ..... B02C 23/02

[52] U.S. Cl. ..... 414/412; 83/923; 83/946; 83/614; 209/3; 53/381.2; 414/411

[58] Field of Search ..... 414/403, 411, 414/412; 83/923, 946, 23, 37, 318, 401, 758, 613, 614; 209/3; 53/381.2

[56] References Cited

U.S. PATENT DOCUMENTS

| | | | |
|---|---|---|---|
| 3,891,105 | 6/1975 | Cerroni | 414/412 |
| 5,101,703 | 4/1992 | Tanaka et al. | 83/946 X |
| 5,282,346 | 2/1994 | Masuda et al. | 414/412 X |
| 5,282,713 | 2/1994 | Lande | 414/412 |
| 5,371,938 | 12/1994 | Martin | 414/412 X |

FOREIGN PATENT DOCUMENTS

| | | | |
|---|---|---|---|
| 59982 | 9/1982 | European Pat. Off. | 414/411 |
| 404272 | 12/1990 | European Pat. Off. | 414/412 |

*Primary Examiner*—Frank E. Werner

*Attorney, Agent, or Firm*—Dirk J. Veneman; Raymond W. Campbell

[57] ABSTRACT

A rigid, box-like frame structure has a vertically movable subframe assembly mounted thereon. Attached to the subframe are a number of horizontally movable tined sleeves with connected sharpened tines. As the subframe assembly moves downwardly, the attached tines penetrate the refuse bags on a conveyor below. The tined sleeves are then moved outwardly by actuators, tearing open the bags and discharging the refuse within. The subframe assembly is then lifted upwardly and the tined sleeves are moved back inwardly to their original position to start the cycle again.

9 Claims, 3 Drawing Sheets

REFUSE BAG OPENING DEVICE

FIELD OF THE INVENTION

The present invention relates to recycling equipment in general and, more particularly, to such equipment which separates trash into recyclable and non-recyclable goods.

BACKGROUND OF THE INVENTION

Now more than ever before municipalities all over the world are experiencing a growing waste disposal problem. Suitable landfill space continues to decrease. Water pollution concerns have severely limited off-shore solid waste disposal. National and international pollution control laws, regulations, and treaties have become much more stringent in recent years. It is now more difficult than ever to get a permit to legally dump wastes and the penalties for dumping wastes illegally have dramatically increased. Further, the existing piles of untreated municipal waste both above and below ground have raised public concerns about future health risks and possible ground water contamination. For these reasons, the continued dumping of solid wastes has become a very unattractive option for most cities.

Therefore, in order to effectively stem the steady flow of refuse into landfills and waterways and make recycling easier, many municipalities and waste management companies have decided to more thoroughly sort their waste into recyclable and non-recyclable goods. Although some municipalities have used public information campaigns to encourage their citizens to separate recyclable and non-recyclable wastes and have passed ordinances establishing fines for those who refuse to recycle, these programs have met with varying levels of success. Thousands of tons of recyclable materials still routinely find their way into landfills or into the sea. Hence, it is imperative that inexpensive and more efficient waste processing methods be ushered in to properly control the rising levels of trash produced by our cities, towns, and villages and make recycling more efficient.

Today, almost all household and non-toxic business trash is collected in plastic refuse bags. For sanitation reasons and consumer convenience, these plastic bags are specifically designed to resist breakage and degradation. However, because the refuse bags are designed to resist breakage, they are difficult to open during processing. Furthermore, the process of collecting, loading and unloading the refuse bags, breaking them open, and sorting and separating the trash into recyclable and non-recyclable materials at a waste processing facility is a very unpleasant and labor intensive task. Hence, many municipalities and waste management companies desire specialized machinery to aid waste processing workers in sorting and separating refuse.

Most of the household waste collected in refuse bags is soft matter. However, cans, bottles, and other recyclable products have a more solid structural integrity. In order to efficiently and effectively recycle these otherwise wasted products, it is necessary to maintain their structural integrity and prevent breakage. A bag breaking device that breaks or damages potentially recyclable containers only creates more unusable wastes that will eventually end up in the already overflowing landfills.

What is needed is a simple, low maintenance, efficient, and economical device to aid in the sorting and separating of refuse which preserves the fragile, potentially recyclable contents within the refuse bag.

SUMMARY OF THE INVENTION

The refuse bag opening apparatus of this invention opens bags for processing of the contents while minimizing damage to bottles, cans, and other recyclable items.

The device consists of a frame with a slidably engaged, vertically movable subframe assembly. A conveyor moves the refuse bags through the frame apparatus and under the subframe assembly. As the conveyor moves the stream of bagged refuse through the frame, an actuator moves the slidably engaged subframe downwardly toward the bags on the conveyor. Horizontally movable sleeves that have tines connected to them are similarly slidably engaged with the subframe. As the subframe descends, the tines puncture the refuse bags and push the potentially recyclable containers aside. Another set of actuators then moves the slidably engaged tined sleeves outwardly in opposite directions, tearing the refuse bags open and discharging the contents within. The subframe actuator then moves the subframe assembly upwardly away from the conveyor and the tined sleeve actuators move the sleeves inwardly back into their original position, ready to begin another puncturing and tearing cycle on the downstroke.

It is a feature of the present invention to provide a simple, low maintenance apparatus for opening refuse bags.

It is another feature of the present invention to provide an apparatus for efficiently and economically opening refuse bags and processing the refuse within the bags.

It is a further feature of the present invention to provide an apparatus for opening refuse bags without damaging the recyclable contents contained within the refuse bags.

Further objects, features and advantages of the invention will be apparent from the following detailed description when taken in conjunction with the accompanying drawings.

DESCRIPTION OF THE PREFERRED EMBODIMENT

Figure 1:
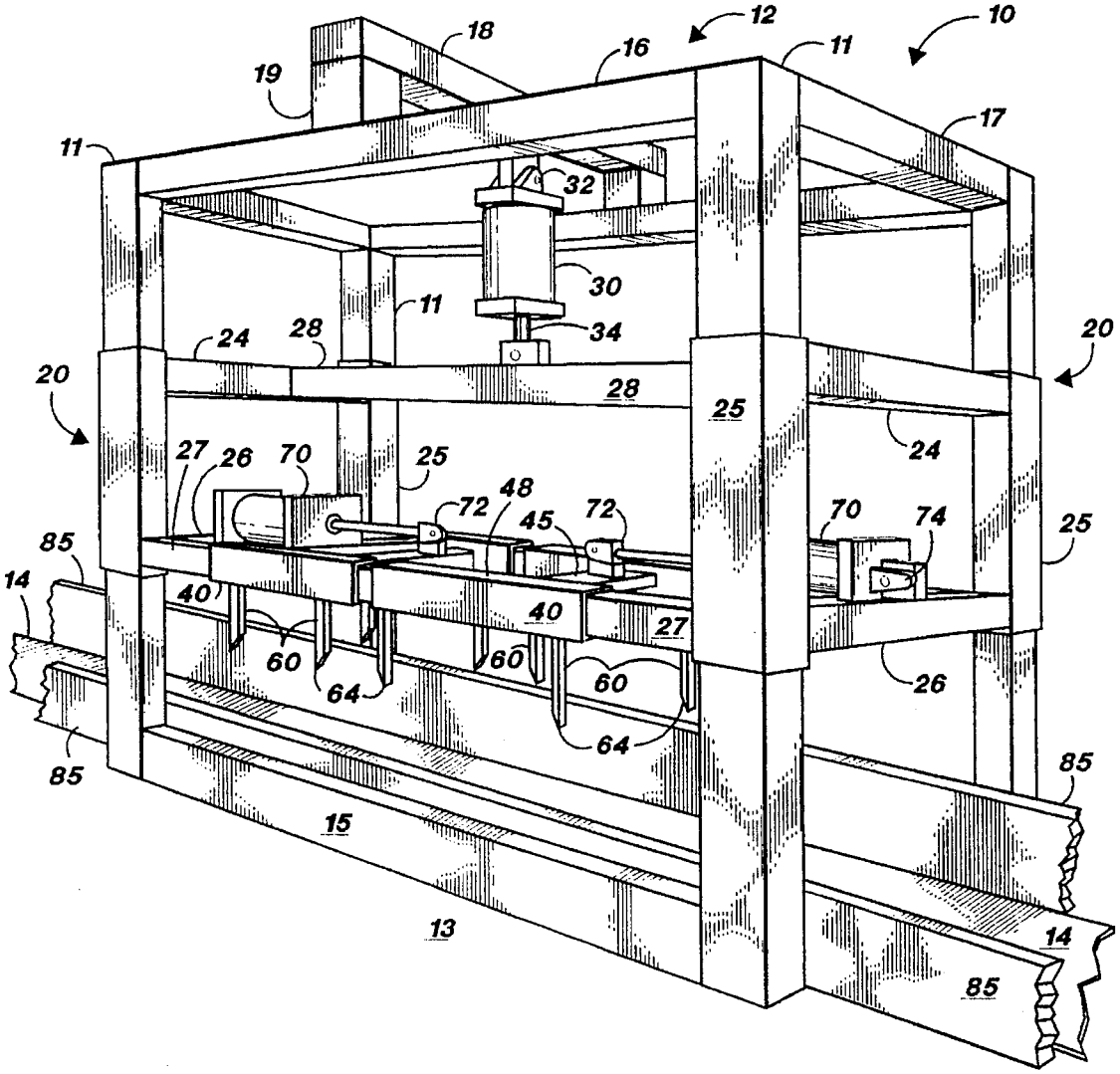
FIG. 1 is an isometric view of the bag opening apparatus of this invention at the beginning of a cycle.

Referring more particularly to FIGS. 1–5, wherein like numbers refer to similar parts, a refuse bag opening apparatus 10 is shown in FIG. 1. Plastic bags of refuse are conveyed by a belt conveyor 14 through a frame 12. Tines mounted on a reciprocating subframe repetitively pierce the bags and withdraw. The tine impact path is configured to minimize crushing of recyclable materials.

The apparatus frame 12 is a rigid box-like structure which is composed of connected steel beams and members. Four square tubular steel corner posts 11 extend upwardly from a concrete foundation 13 which supports the weight of the entire apparatus 10. A belt conveyor 14 is positioned above the concrete foundation 13 and runs from front to rear through the corner posts 11. A horizontal lower member 15 extends between two corner posts 11 on each side of the conveyor 14. The lower members are positioned on the foundation 13 to provide increased stability for the apparatus 10. The corner posts 11 are connected by horizontal top members 16 and 17 which form a rectangular top frame. Two steel spacing blocks 19 are welded to the steel top members 16. The two spacing blocks 19 provide support for an overhead steel beam 18 to which is mounted an actuator 30.

The subframe assembly 20 is a rectangular box-like structure which has four square tubular vertical guide sleeves 25 which fit telescopically around the corner posts 11 of the apparatus 10 to permit vertically reciprocating motion. The subframe guide sleeves 25 are connected by two upper cross beams 24 and two lower cross-beams 26 which are parallel to the upper cross-beams. The upper cross beams 24 are joined by a central member 28. Two parallel rails 27 extend between the lower cross-beams 26.

The actuator 30, which is preferably hydraulic, but which may alternatively be pneumatic or mechanical, extends between the frame 12 and the subframe 20, and has ears 32 which are connected to the frame overhead beam 18 and a piston 34 which is connected to the subframe central member 28. The actuator 30 moves the subframe assembly 20 vertically with respect to the frame 12. Reciprocating motion of the actuator piston 34 causes the subframe to move from an elevated position spaced above the conveyor, and a lowered position in which tines 60 engage refuse bags 50.

Two tine assemblies 48 are mounted to the subframe rails 27 for reciprocating motion in a horizontal plane. Each tine assembly has two tubular steel sleeves 40 which slide telescopically on the parallel rails 27. The two sleeves 40 are connected by an attachment bar 45. Each tined sleeve 40 has two downwardly pointing sharp steel bar puncturing tines 60 connected to its underside. The steel tines 60 have an inclined downwardly facing point 64, which is formed by an inclined cutoff of the tine 60. The inclined surfaces of the points 64 of the tines 60 on the two tine sleeve assemblies 48 face toward one another.

The two tine assemblies 48 are caused to reciprocate toward and away from each other by hydraulic tine actuators 70 which are pivotally mounted by ears 74 to the subframe members 26. Each actuator 70 has an extendable piston 72 which is connected to the tine assembly attachment bars 45.

Municipal waste processing facilities receive many plastic refuse bags 50. The refuse bags are typically formed of thin sheet plastic and are closed by clips or tabs. Each bag is filled with a mixture of refuse, including paper products, plastic bottles, cans, and glass. A supply of refuse, including sealed bags 50 is advanced into the apparatus 10 by the conveyor 14 in a continuous stream from an unloading area.

Figure 2:
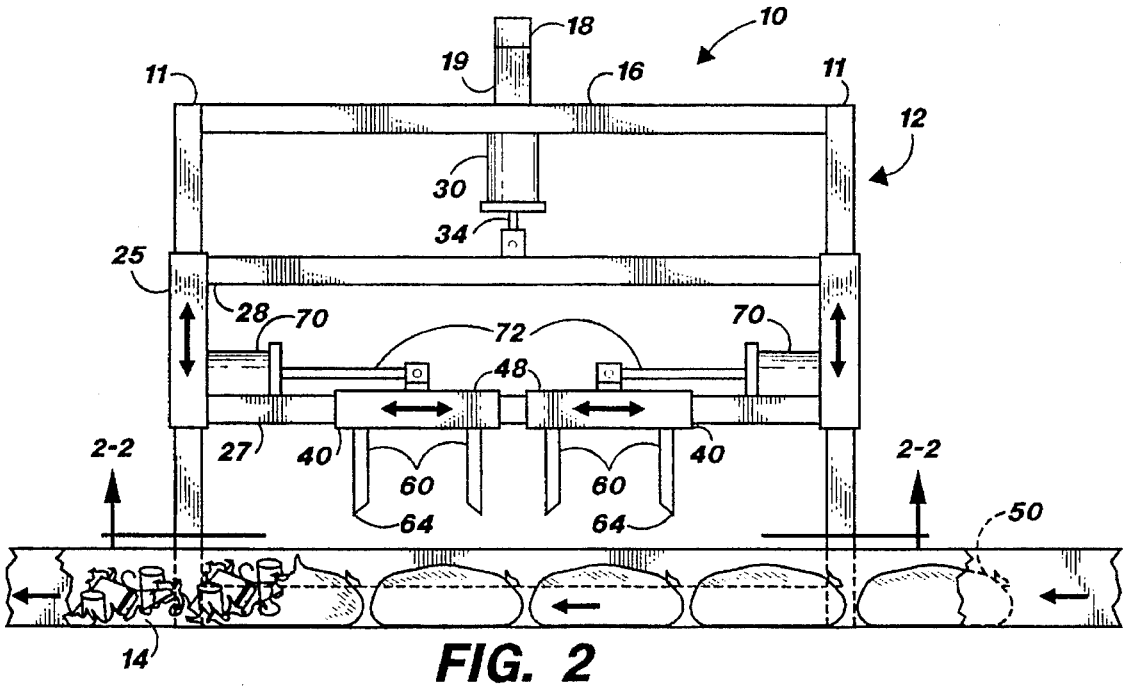
FIG. 2 is a side elevational view of the apparatus of FIG. 1.

The subframe 20 and the tine assemblies 48 are moved in a reciprocating pattern by a control mechanism (not shown) which may be a system of relays, a digital controller, or a simply mechanical arrangement. As shown in FIG. 2, the conveyor speed and the motion of vertical motion of the subframe are coordinated such that the bags 50 which enter the apparatus 10 are in position beneath the tines 60 long enough to be opened.

Figure 3:
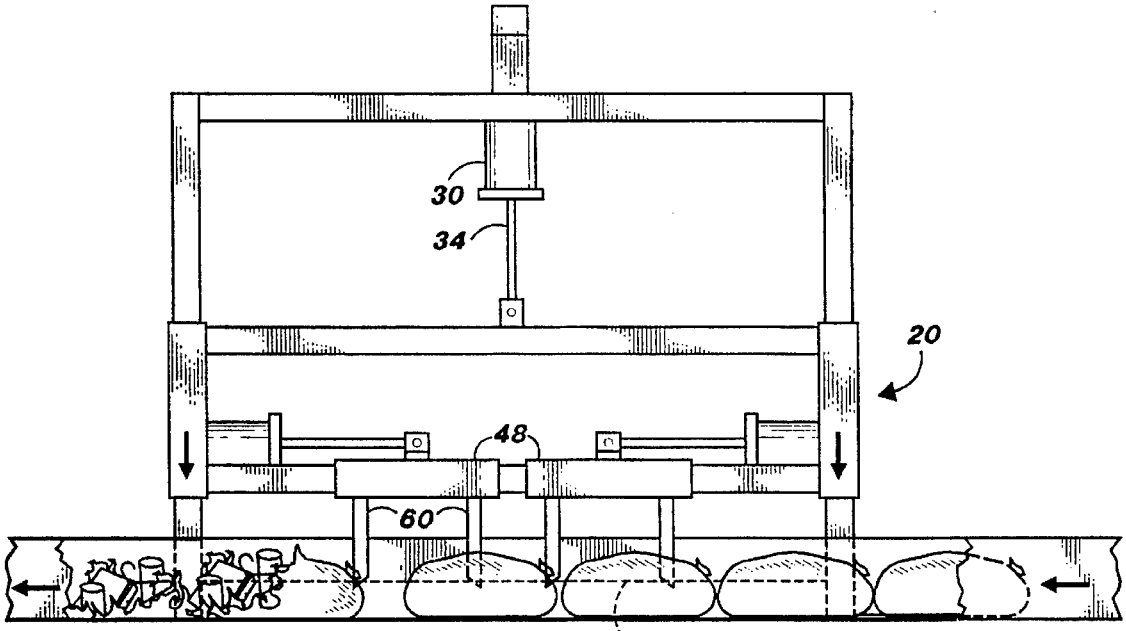
FIG. 3 is a side elevational view of the apparatus of FIG. 1 showing the subframe moving into a mid-cycle down position.
Figure 4:
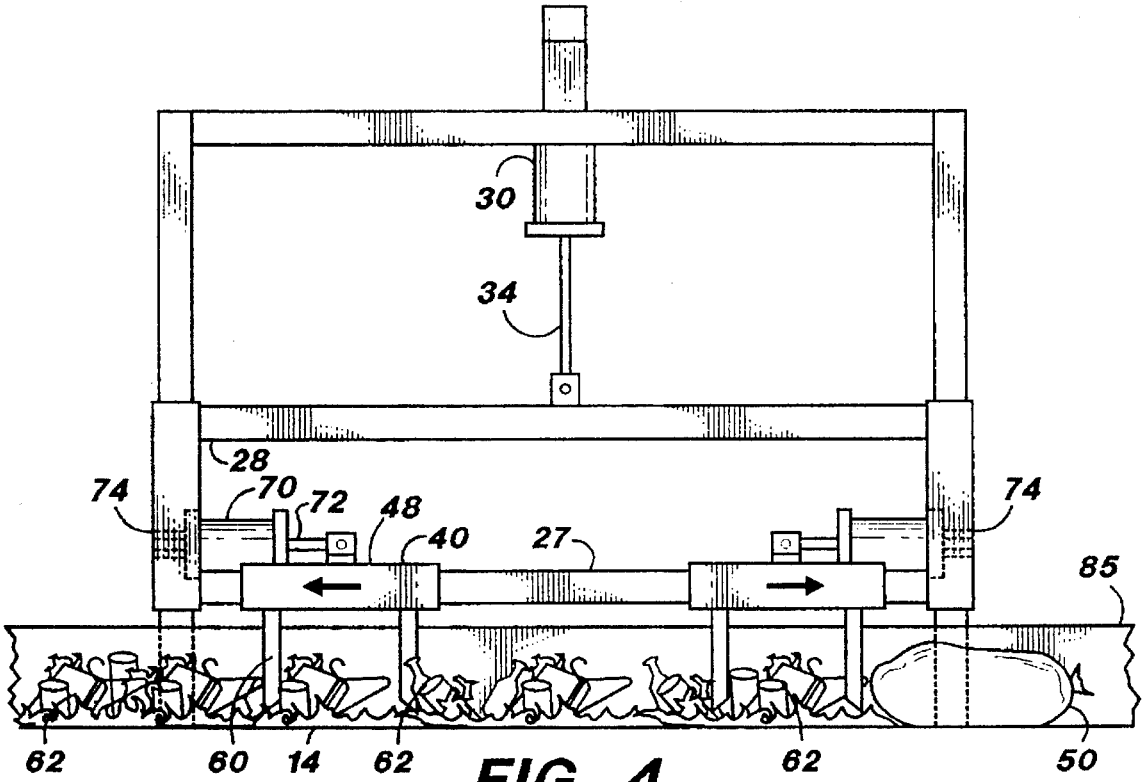
FIG. 4 is a side elevational view of the apparatus of FIG. 1 showing the tined sleeves moving outwardly along the shafts.
Figure 5:
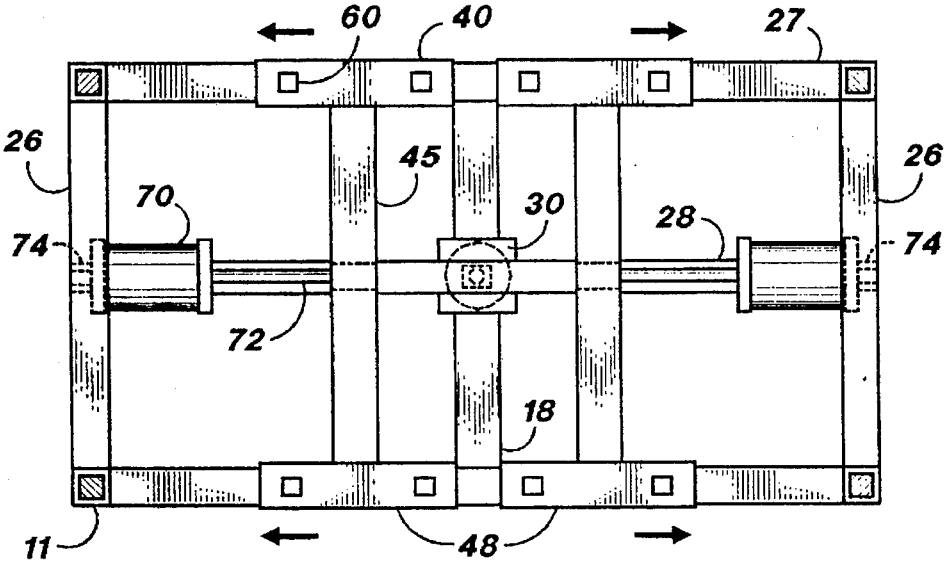
FIG. 5 is a bottom cross-sectional view of the apparatus of FIG. 2, taken along section line 2—2.

The conveyor 14 moves the refuse bags 50 through the apparatus 10 and into position within the frame 12 directly below the tine assemblies 48. The subframe actuator piston 34 extends downwardly to drive the subframe assembly 20 and the connected tine assemblies 48 downwardly toward the conveyor 14. As the subframe assembly 20 is lowered, the tined sleeves 40 and their connected tines 60 puncture the refuse bags 50 as shown in FIG. 3.

Once the tines 60 are engaged with the bags 50, the tine assembly actuators 70 operate to pull the tined sleeves 40 outwardly along the rails 27. As the tined sleeves 40 are pulled outwardly, the tines 60 that were inserted in the refuse bags 50 by the downstroke of the subframe assembly 20 rip open the refuse bags 50 and scatter their contents out onto the conveyor 14. This two step process of first piercing the bags and then tearing them open minimizes crushing impact of the tines on bottles and glass containers 62 within the bags 50. The angled points 64 of the tines also serve to displace large objects from the path of the tines as they descend, further contributing to retaining the integrity of recyclable articles within the bags 50.

When the tine assemblies 48 are moved horizontally, the tines 60 extend in a horizontal path, generally avoiding any crushing action on the bag contents, but thoroughly disrupting the bags 50. Glass, plastic, or metal containers 62 are more easily recycled if the containers remain unbroken during processing.

The conveyor 14 has a wall 85, best shown in FIG. 1, to prevent the trash contained within the refuse bags 50 from falling off of the conveyor and onto the processing plant floor 13 as the refuse bags are punctured and torn open by the tines 60.

After the pistons 72 of the tine actuators 70 have fully retracted, the subframe assembly actuator 30 retracts, thereby lifting the subframe 20 from the belt conveyor 14 back into the up position as shown in FIG. 2. On the upward travel of the subframe 20, both pistons 72 of the tine actuators 70 simultaneously extend to return the tine assemblies 48 to a central position for repetition of the cycle. The cycle will continue to repeat itself until the system is shut down by an operator.

Although hydraulic actuators 30 and 70 have been disclosed above, pneumatic, chain, pulley, gear, or belt actuators may also be employed. Other embodiments of the apparatus may have different tined sleeve 40 or tine 60 configurations. For example, four tined sleeves 40 may be mounted on each lower beam 27. Furthermore, additional or fewer tines may be connected to each sleeve. Also, the apparatus may have tines 60 wherein both sides come to a point in the middle rather than having one side longer than the other. Alternatively, the longer side of each tine may face inwardly instead of outwardly.

It should be noted that although a belt conveyor has been disclosed for advancing the refuse bags to be opened, other conveyors may also be employed, for example a steel link or vibratory conveyor, or, in cases where separation on the basis of size is desired, a bar screen or disk screen conveyor.

It is understood that the invention is not limited to the particular embodiments disclosed and illustrated herein, but embraces such modified forms thereof as come within the scope of the following claims.

I claim:

1. An apparatus for opening refuse bags comprising:

a frame;

a subframe mounted to the frame for reciprocating vertical motion;

a conveyor which transports the refuse bags to be opened along a path through the frame below the subframe;

at least two sleeves slidably mounted to the subframe for horizontal motion with respect to the subframe;

at least one tine connected to each sleeve and extending downwardly toward the conveyor;

a subframe actuator extending between the frame and the subframe wherein the subframe actuator moves the subframe between an elevated position in which the tines are above the refuse bags on the conveyor, and a lowered position in which the tines engage the refuse bags on the conveyor; and sleeve actuators which extend between the subframe and the sleeves, the sleeve actuators operating to displace the sleeves horizontally with respect to the subframe when the subframe is in the lowered position to disrupt the refuse bags carried on the conveyor and discharge the contents thereof.

2. The apparatus of claim 1 wherein the frame has four vertically extending side columns, and wherein the subframe has four tubular side members, and the frame columns extend through the subframe side members.

3. The apparatus of claim 1 wherein the tines have an inclined point, such that objects beneath a tine will be urged out of the path of the tine as the tine moves downwardly.

4. The apparatus of claim 1 wherein the tine actuators are configured to move the tine sleeves away from one another when the subframe is in the lowered position.

5. An apparatus for opening refuse bags comprising:

a conveyor having an inlet end and an outlet end wherein the conveyor transports the bags to be opened along a path;

a frame mounted over the conveyor;

a subframe slidably engaged with the frame for vertical reciprocal motion;

a subframe actuator extending between the subframe and the frame, wherein the subframe actuator is operable to move the subframe between a lowered position and an elevated position;

a first sleeve assembly mounted to the subframe for horizontal motion thereon;

a second sleeve assembly mounted to the subframe for horizontal motion thereon;

at least one tine connected to each sleeve and extending downwardly toward the conveyor;

a first sleeve actuator extending between the subframe and the first sleeve; and a second sleeve actuator extending between the subframe and the second sleeve; wherein the first sleeve actuator and the second sleeve actuator are operable to move the sleeves from a substantially adjacent position to a horizontally spaced position, and wherein the tines are spaced vertically above refuse bags carried on the conveyor in the subframe elevated position, and the tines engage with the refuse bags in the subframe lowered position, the tine actuators operating to displace the tines horizontally in the subframe lowered positions to rupture the refuse bags and discharge the contents thereof.

6. The apparatus of claim 5 wherein the subframe has two horizontally extending parallel rails, and wherein the sleeve assemblies are mounted for sliding motion on the rails.

7. The apparatus of claim 5 wherein the frame has four parallel vertical columns, and the subframe assembly has four tubular side members which slide on the columns.

8. The apparatus of claim 5 further comprising a controller which controls the subframe actuator and the tine actuators to space the tine assemblies from one another when the subframe is in the lowered position and to bring the tine assemblies closer together when the subframe is in the elevated position.

9. The apparatus of claim 5 wherein the tines have an inclined point, such that objects beneath a tine will be urged out of the path of the tine as the tine moves downwardly.

* * * * *